US006474495B1

(12) United States Patent
Frei

(10) Patent No.: US 6,474,495 B1
(45) Date of Patent: Nov. 5, 2002

(54) GARBAGE CAN AND METHOD THEREFOR

(76) Inventor: Lynn A. Frei, 6535 Gunderson Blvd., Las Vegas, NV (US) 89103

( * ) Notice: Subject to any disclaimer, the term of this patent is extended or adjusted under 35 U.S.C. 154(b) by 0 days.

(21) Appl. No.: 09/961,892

(22) Filed: Sep. 24, 2001

(51) Int. Cl.[7] ..... B65D 25/14
(52) U.S. Cl. ..... 220/495.08; 220/908.1
(58) Field of Search ..... 220/495.04, 908.1

(56) References Cited

U.S. PATENT DOCUMENTS 1,026,081 A * 5/1912 Dorais ..... 220/495.11
4,765,579 A * 8/1988 Robbins, III et al. ... 220/495.04
5,690,247 A * 11/1997 Boover ..... 220/495.11
6,126,031 A * 10/2000 Reason ..... 220/495.04
6,253,949 B1 * 7/2001 Dickson ..... 220/495.04

* cited by examiner

*Primary Examiner*—Joseph M. Moy
(74) *Attorney, Agent, or Firm*—Harry M. Weiss; Jeffrey D. Moy; Weiss, Moy & Harris, PC

(57) ABSTRACT

An improved garbage can defining apertures around an open end and a closed end of a receptacle in order to maintain equilibrium of air pressure within the receptacle so as to avoid the suction-cup effect when inserting and removing a garbage bag from the receptacle.

17 Claims, 2 Drawing Sheets

GARBAGE CAN AND METHOD THEREFOR

FIELD OF THE INVENTION

This invention relates generally to garbage cans and, more specifically, to an improved garbage can defining apertures around an open end and a closed end in order to maintain equilibrium of air pressure to avoid the suction-cup effect when inserting and removing a garbage bag from a garbage can.

BACKGROUND OF THE INVENTION

It in often difficult to place a garbage bag into—or remove a garbage bag from—a tight-fitting garbage can. When placing a garbage bag into a garbage can, the volume of the garbage bag must displace the volume of air already existing in the garbage can. In order for the air to be displaced it must find a way to exit the garbage can. This is often a problem, however, because most garbage cans only contain one open end which is blocked by the entering garbage bag. The result is that the garbage bag can only be inserted with great difficulty and only after the air trapped inside the garbage can is able to escape around the entering garbage bag. Removing a garbage bag can also be difficult, but for the opposite reason. When removing a garbage bag, the volume or the garbage bag being removed from the garbage can must be replaced by an equal volume of air. It is often the case, however, that when removing a garbage bag there is no easy way for air to enter the garbage can. The result is that the bag can only be removed with tremendous exertion and only after air from outside or the garbage can is able to enter the garbage can around the exiting garbage bag. This phenomenon, in which tremendous exertion is needed until the flow of air creates equilibrium is known as the "suction-cup effect."

One solution to this problem is to simply use a smaller garbage bag or a larger garbage can, leaving plenty of room for air to enter and exit the garbage can and thus avoiding any suction-cup effect. This solution is inefficient, however, since it does not maximize the capacity of a garbage can. Similarly, in crowded areas such a solution is impractical due to the need to dispose of the maximum amount of garbage in the smallest amount of space.

A need therefore existed for an improved garbage can defining apertures in a bottom and upper portion thereof in order to allow air to enter and exit the garbage can when a garbage bag is removed and inserted, respectively, thus allowing a person to insert and remove a garbage bag into and from, a garbage can without difficulty.

SUMMARY OF THE INVENTION

An object of the present invention is to provide a garbage can destining a plurality of apertures in a lower portion and an upper portion thereof so as to allow a garbage bag to be inserted end removed without the difficulties associated with the suction-cup effect.

BRIEF DESCRIPTION OF THE PREFERRED EMBODIMENTS

In accordance with one embodiment of the present invention, an improved garbage can is disclosed, comprising a receptacle having an open end and a closed end and dimensioned to receive a garbage bag through the open end, wherein the receptacle defines a plurality of apertures proximate the open end dimensioned to expel air out of the receptacle when the garbage bag is inserted into the receptacle while at the same time the apertures of the open end are dimensioned to draw air into the receptacle when the garbage bag is removed from the receptacle, wherein the receptacle defines a plurality of apertures proximate the closed end dimensioned to expel air out of the receptacle when the garbage bag is inserted into the receptacle while at the same time the apertures of the closed end are dimensioned to draw air into the receptacle when the garbage bag is removed from the receptacle.

In accordance with another embodiment of the present invention, a method for inserting a garbage bag into a receptacle is disclosed, comprising, in combination, the steps of providing a receptacle having an open end and a closed end and dimensioned to receive a garbage bag through the open end, wherein the receptacle defines a plurality of apertures proximate the open and dimensioned to expel air out of the receptacle when the garbage bag is inserted into the receptacle while at the same time the apertures of the open end are dimensioned to draw air into the receptacle when the garbage bag is removed from the receptacle, wherein the receptacle defines a plurality of apertures proximate the closed end dimensioned to expel air out of the receptacle when the garbage bag is inserted into the receptacle while at the same time the apertures of the closed end are dimensioned to draw air into the receptacle when the garbage bag is removed from the receptacle, providing a garbage bag, and inserting the garbage bag into the receptacle.

In accordance with yet another embodiment of the present invention, a method for removing a garbage bag from a receptacle is disclosed, comprising, in combination, the steps of providing a receptacle having an open end and a closed end and dimensioned to receive a garbage bag through the open end, wherein the receptacle defines a plurality of apertures proximate the open end dimensioned to expel air out of the receptacle when the garbage bag is inserted into the receptacle while at the same time the apertures of the open end are dimensioned to draw air into the receptacle when the garbage bag is removed from the receptacle, wherein the receptacle defines a plurality of apertures proximate the closed end dimensioned to expel air out of the receptacle when the garbage bag is inserted into the receptacle while at the same time the apertures of the closed end are dimensioned to draw air into the receptacle when the garbage bag is removed from the receptacle, providing a garbage bag filled with garbage, wherein the filled garbage bag has an outer diameter substantially the same as an inner diameter of the receptacle, and removing the garbage bag from the receptacle.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
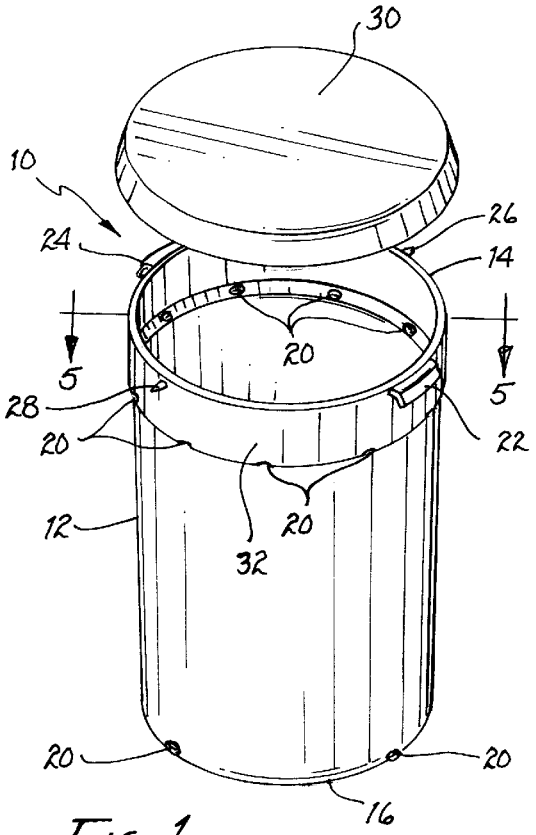
FIG. 1 is a perspective view of the receptacle of the preferred embodiment of the improved garbage can of the present invention.
Figure 2:
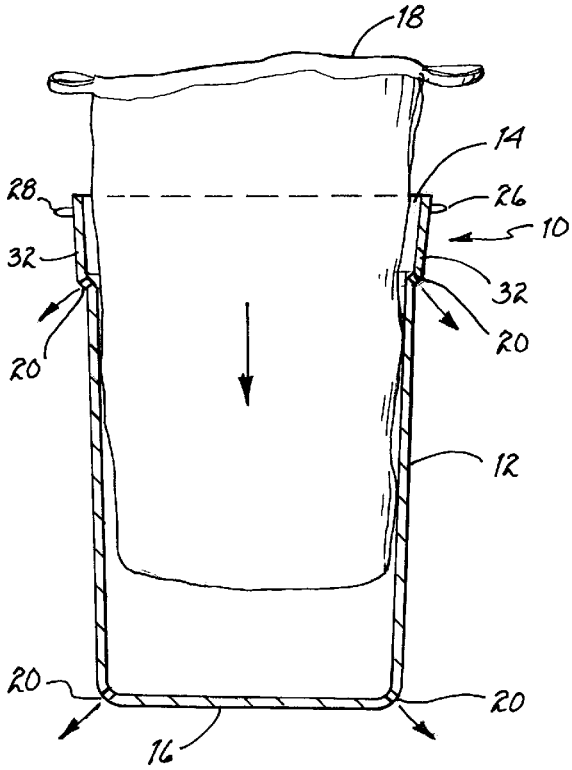
FIG. 2 is a side, cross-sectional view of the improved garbage can of FIG. 1, showing a garbage bag being inserted into the receptacle.
Figure 3:
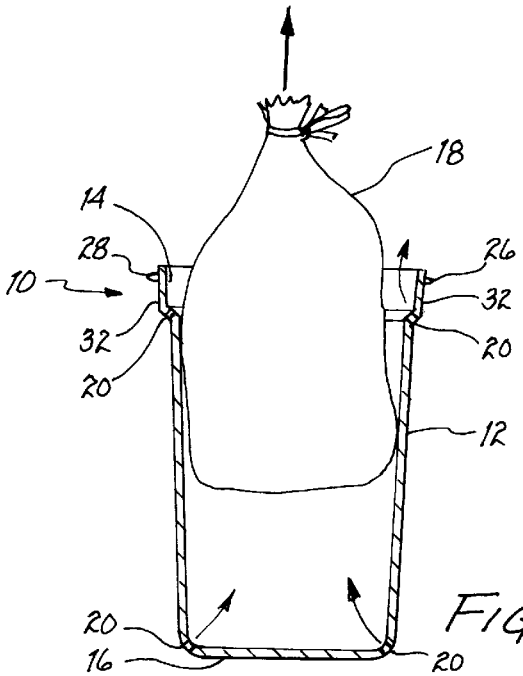
FIG. 3 is a side, cross-sectional view of the improved garbage can of FIG. 1, showing a garbage bag being removed from the receptacle.
Figure 4:
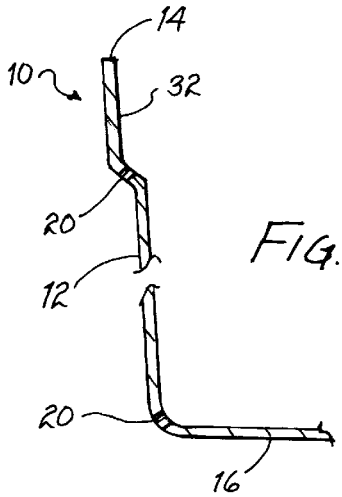
FIG. 4 is a partial, cross-sectional view of the improved garbage can or FIG. 1, showing both the open end and the closed end of tho receptacle and the apertures defined by both the open end and the closed end.
Figure 6:
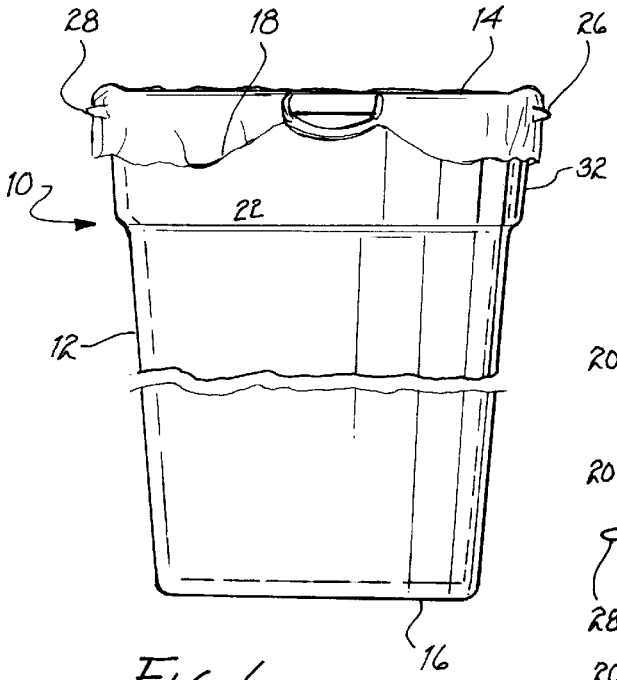
FIG. 6 is a side view of the improved garbage can of FIG. 1, showing an upper portion of the garbage bag coupled to: the first handle, the second handle, the first protrusion member, and the second protrusion member.
Figure 5:
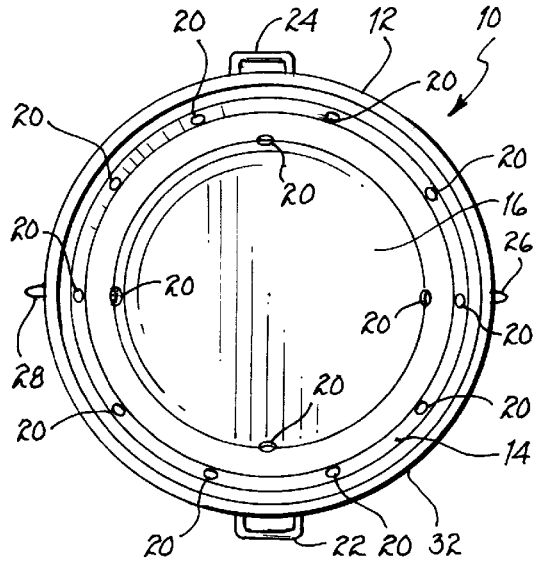
FIG. 5 is a top view of the improved garbage can of FIG. 1, showing the apertures defined by both the open and and the closed end of the receptacle, taken along line 5—5.
Figure 7:
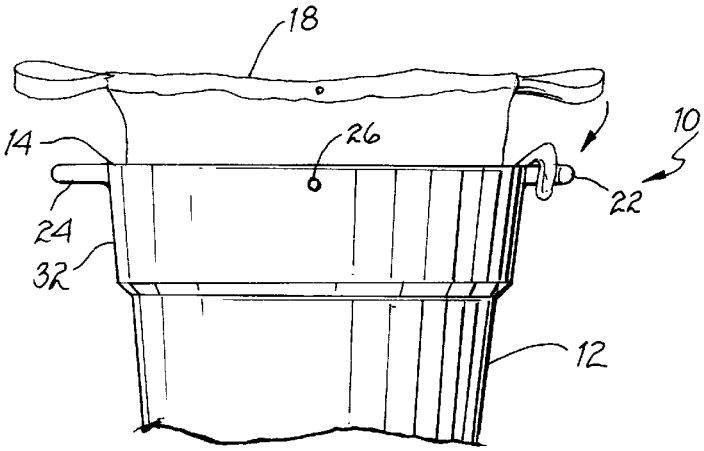
FIG. 7 in a side view of an upper portion of the receptacle of the improved garbage can of FIG. 1, showing how the garbage bag is coupled to the first handle.

Referring to FIGS. 1–7 reference number 10 refers generally to the preferred embodiment of the improved garbage can of the present invention. The improved garbage can 10 comprises a receptacle 12 having an open end 14 and a closed end 16 and is dimensioned to receive a garbage bag 18 through the open end 14. The open end 14 of the receptacle 12 defines a plurality of apertures 20 dimensioned to expel air out of the receptacle 12 when the garbage bag 18 is inserted into the receptacle 12 while at the same time the apertures 20 of the open end 14 are dimensioned to draw air into the receptacle 12 when the garbage bag 19 is removed from the receptacle 12. The closed end 16 of the receptacle 12 also defines a plurality of apertures 20 dimensioned to expel air out of the receptacle 12 when the garbage bag 18 is inserted into the receptacle 12 while at the same time the apertures 20 of the closed end 16 are dimensioned to draw air into the receptacle 12 when the garbage bag 18 is removed from the receptacle 12. In the preferred embodiment, the open end 14 of the receptacle 12 defines ten apertures 20 evenly spaced around the open end 14 and the closed end 16 defines four apertures 20 evenly spaced around the closed end 16, although it should be clearly understood that substantial benefit could be derived from an alternative configuration of the improved garbage can 10 in which the number of apertures 20 in the open end 14 and/or the closed end 16 deviates, even substantially, from the preferred number of apertures 20 in either direction.

Referring now to FIGS. 1, 5, 6 and 7, the improved garbage can 10 preferably comprises a first handle 22 coupled to a first side of the open end 14 of the receptacle 12 and a second handle 24 coupled to a second side of the open end 14 of the receptacle 12. Together, the first handle 22 and the second handle 24 are used to aid in carrying the receptacle 12. In the preferred embodiment, the improved garbage can 10 further comprises a first protrusion member 26 coupled to a third side of the open end 14 of the receptacle 12 and dimensioned to penetrate through a garbage bag 18. The improved garbage can 10 preferably also comprises a second protrusion member 28 coupled to a fourth aide of the open end 14 of the receptacle 12 and dimensioned to penetrate through a garbage bag 13. Together, the first protrusion member 26 and the second protrusion member 28 are able to secure the open end of the garbage bag 18 to the open end 14 of the receptacle 12. This is useful when one desires to place an empty garbage bag 18 into the receptacle 12 and then subsequently fill it with refuse (not shown).

Referring now to FIG. 1, the improved garbage can 10 preferably comprises a lid 30 dimensioned to be coupled to the open end 14 of the receptacle 12, although it should be clearly understood that substantial benefit could be derived from an alternative configuration of the improved garbage can 10 which lacks a lid 30.

In the preferred embodiment, the open end 14 of the receptacle 12 is comprised of a rim 32 having a diameter greater than the closed end 16 of the receptacle 12. A lower portion of the rim 32 preferably defines the plurality of apertures 20 proximate the open end 14.

While the invention has been particularly shown and described with reference to preferred embodiments thereof, it will be understood by those skilled in the art that the foregoing and other changes in form and details may be made therein without departing from the spirit and scope of the invention.

I claim:

1. An improved garbage can comprising:

a receptacle having an open end and a close end and dimensioned to receive a garbage bag through said open end wherein the open end has a rim having a diameter greater than said closed end;

a first handle coupled to a first side of said open end of said receptacle;

a second handle coupled to a second side of said open end of said receptacle;

a first protrusion member coupled to a third side of said open end of said receptacle and dimensioned to penetrate through said garbage bag; and a second protrusion member coupled to a fourth side of said open end of said receptacle and dimensioned to penetrate through said garbage bag; and wherein said receptacle defines a plurality of apertures formed around a circumference of said rim of said open end and dimensioned to expel air out of said receptacle when said garbage bag is inserted into said receptacle while at the same time said apertures of said open end are dimensioned to draw air into said receptacle when said garbage bag is removed from said receptacle;

wherein said receptacle defines a plurality of apertures proximate said closed end dimensioned to expel air out of said receptacle when said garbage bag is inserted into said receptacle while at the same time said apertures of said closed end are dimensioned to draw air into said receptacle when said garbage bag is removed from said receptacle.

2. The improved garbage can of claim 1 further comprising a lid dimensioned to be coupled to said open end of said receptacle.

3. The improved garbage can of claim 1 wherein said open end of said receptacle defines 10 apertures evenly spaced around said open end of said receptacle.

4. The improved garbage can of claim 1 wherein said closed end of said receptacle defines 4 apertures evenly spaced around said closed end of said receptacle.

5. The improved garbage can of claim 1 wherein said open end of said receptacle is comprised of a rim having a diameter greater than said closed end of said receptacle.

6. The improved garbage can of claim 5 wherein a lower portion of said rim defines said plurality of apertures proximate said open end of said receptacle.

7. A method for inserting a garbage bag into a receptacle, comprising, in combination, the steps of:

providing a receptacle having an open end and a close end and dimensioned to receive a garbage bag through said open end wherein the open end has a rim having a diameter greater than said closed end;

providing a first handle coupled to a first side of said open end of said receptacle;

providing a second handle coupled to a second side of said open end of said receptacle;

providing a first protrusion member coupled to a third side of said open end of said receptacle and dimensioned to penetrate through said garbage bag; and providing a second protrusion member coupled to a fourth side of said open end of said receptacle and dimensioned to penetrate through said garbage bag; and wherein said receptacle defines a plurality of apertures formed around a circumference of said rim of said open end and dimensioned to expel air out of said receptacle when said garbage bag is inserted into said receptacle while at the same time said apertures of said open end are dimensioned to draw air into said receptacle when said garbage bag is removed from said receptacle;

wherein said receptacle defines a plurality of apertures proximate said closed end dimensioned to expel air out of said receptacle when said garbage bag is inserted into said receptacle while at the same time said apertures of said closed end are dimensioned to draw air into said receptacle when said garbage bag is removed from said receptacle;

providing a garbage bag;

inserting said garbage bag into said receptacle;

puncturing a first side of an open end of said garbage bag with said first protrusion member; and puncturing a second side of an open end of said garbage bag with said second protrusion member so as to maintain said open end of said garbage bag open in a position to receive garbage.

8. The method of claim 7 further comprising the step of providing a lid dimensioned to be coupled to said open end of said receptacle.

9. The method of claim 7 wherein said open end of said receptacle defines 10 apertures evenly spaced around said open end of said receptacle.

10. The method of claim 7 wherein said closed end of said receptacle defines 4 apertures evenly spaced around said closed end of said receptacle.

11. The method of claim 7 wherein said open end of said receptacle in comprised of a rim having a diameter greater than said closed end or said receptacle.

12. The method of claim 7 wherein a lower portion of said rim defines said plurality of apertures proximate said open end of said receptacle.

13. A method for removing a garbage bag from a receptacle, comprising, in combination, the steps of:

providing a receptacle having an open end and a close end and dimensioned to receive a garbage bag through said open end wherein the open end has a rim having a diameter greater than said enclosed end;

providing a first handle coupled to a first side of said open end of said receptacle;

providing a second handle coupled to a second side of said open end of said receptacle;

providing a first protrusion member coupled to a third side of said open end of said receptacle and dimensioned to penetrate through said garbage bag; and providing a second protrusion member coupled to a fourth side of said open end of said receptacle and dimensioned to penetrate through said garbage bag; and wherein said receptacle defines a plurality of apertures formed around a circumference of said rim of said open end dimensioned to expel air out of said receptacle when said garbage bag is inserted into said receptacle while at the same time said apertures of said open end are dimensioned to draw air into said receptacle when said garbage bag is removed from said receptacle;

wherein said receptacle defines a plurality of apertures proximate said closed end dimensioned to expel air out of said receptacle when said garbage bag is inserted into said receptacle while at the same time said apertures of said closed end are dimensioned to draw air into said receptacle when said garbage bag is removed from said receptacle;

providing a garbage bag filled with garbage, wherein said filled garbage bag has an outer diameter substantially the same as an inner diameter of said receptacle;

disengaging a first side of an open end of said garbage bag from said first protrusion member; and disengaging a second side of an open end of said garbage bag from said second protrusion member; and removing said garbage bag from said receptacle.

14. The method of claim 13 wherein said open end of said receptacle defines 10 apertures evenly spaced around said open end of said receptacle.

15. The method of claim 13 wherein said closed end of said receptacle defines 4 apertures evenly spaced around said closed end of said receptacle.

16. The method of claim 13 wherein said open end of said receptacle is comprised of a rim having a diameter greater than said closed end of said receptacle.

17. The method of claim 13 wherein a lower portion of said rim defines said plurality of apertures proximate said open end of said receptacle.

* * * * *